United States Patent [19]

Surabian

[11] 4,069,853

[45] Jan. 24, 1978

[54] PROTECTIVE COVER FOR WIGS

[76] Inventor: Gisele A. Surabian, 57 Essex St., Saugus, Mass. 01906

[21] Appl. No.: 760,245

[22] Filed: Jan. 31, 1977

[51] Int. Cl.[2] ..... B65D 85/18

[52] U.S. Cl. ..... 150/52 R; 135/5 E

[58] Field of Search ..... 150/52 R; 206/8; 135/5 R, 5 E, 1 R; 312/284, 137; 229/22

[56] References Cited

U.S. PATENT DOCUMENTS

| | | | |
|---|---|---|---|
| 437,145 | 9/1890 | Craige | 312/284 |
| 505,354 | 9/1893 | Garbesi | 135/5 E |
| 663,306 | 12/1900 | Tompkins | 150/52 R |
| 1,649,324 | 11/1927 | Raber | 135/1 R |
| 1,820,040 | 8/1931 | Zuckerman | 150/52 R UX |
| 2,013,691 | 9/1935 | Martinson | 135/5 E X |
| 3,690,334 | 9/1972 | Miller | 135/1 R |

FOREIGN PATENT DOCUMENTS

| | | | |
|---|---|---|---|
| 305,518 | 2/1929 | United Kingdom | 229/22 |

*Primary Examiner*—Donald F. Norton
*Attorney, Agent, or Firm*—Walter J. Kreske

[57] ABSTRACT

A very low cost protective cover for placement over a wig carried on a wig stand resting on a flat surface, the wig cover having thin transparent flexible plastic material walls of similar shape with each wall having two opposed parallel sides and two opposed ends, each of the opposed sides being joined to an associated opposed side of an adjacent wall in manner such that one end of each of the walls is in the same plane and each of the walls has a width which combined is sufficient to form a self standing enclosure about the wig without touching the wig and with the one end of the walls resting on the flat surface, the other end of each of the walls is in the form of an isosceles triangle with the equal sides of the triangles having contiguous edges fixed together to form a protective pyramid over the wig, and the contiguous edges being fixed together in manner to form beams for rigidizing the cover to enhance the self standing capability of the enclosure.

7 Claims, 8 Drawing Figures

PROTECTIVE COVER FOR WIGS

BACKGROUND OF THE INVENTION

1. Field of the Invention

The present invention relates to protective covers for wigs and the like and more particularly to a very inexpensive protective cover for a wig or the like carried on a wig stand resting on a flat surface such as a shelf or dresser.

2. Prior Art

The purchase of a wig is normally accompanied by an artificial head or stand on which the wig is stored or carried when not in use and the wig stand usually has a bottom adapted for standing or being carried on the flat surface of a shelf or dresser or the like. In today's cities it is common for women to have several wigs, some of which may have different hair styling for use on different occasions. Thus some of the wigs may not be used for extended periods of time and are left on the wig stand on a shelf or dresser where dust and other airborn dirt accumulates, causing injury to the wig or requiring relatively frequent and expensive professional cleaning and resetting of the hair style.

While there are special commercially available structures for storing wigs inside protective containers, they are generally relatively complex and expensive. One such structure is that disclosed in U.S. Pat. No. 3,820,694 which is comprised of a multiplicity of parts having a bulk and complexity of structure necessitating a substantial manufacturing cost as well as a special set-up arrangement at the point of use before it can be used for wig storage.

Other structures are disclosed in U.S. Pats. Nos. 3,327,842 and 3,658,174, both of which in various form combine a storage box with particular configurations of wig stands comprised of several relatively complicated components necessitating a substantial manufacturing cost.

These structures in themselves are not only relatively expensive, but are also bulky and necessitate the relinquishing of the wig stand supplied with the wig at the time of its purchase and thus are probably justified only for length transporation of a wig in manner other than on the head of the owner. They are uneconomical solution of the wig storage problem for the owner of one or more wigs kept at home.

The present invention, as will hereinafter become apparent, provides an extremely inexpensive solution to protecting a wig from accumulating dust or dirt during storage and does not necessitate the relinquishment of the wig stand which accompanied the wig purchase. Also the present invention occupies only an extremely small amount of space when not in use for protecting a stored wig.

SUMMARY OF THE INVENTION

In accordance with the present invention, there is provided a protective cover for placement over a wig carried on a wig stand resting on a flat surface, the protective cover is comprised of thin flexible material walls of similar shaped with each wall having two opposed sides and two opposed ends, each of the opposed sides of each of the walls being substantially parallel and joined to an associated one of the opposed sides of an adjacent wall in manner such that one end of each of the walls is in substantially the same plane, the walls are of a width such that when combined they form a self standing enclosure about the wig with none of the walls touching the wig and with the one end of each of the walls resting on the flat surface, the other end of each of the walls terminates in an isosceles triangular shaped portion with the equal sides of the triangular shaped portion having contiguous edges fixed together to form a pyramid over the wig and the contiguous edges are fixed together in manner to form beams for providing rigidizing framing for the protective cover to enhance the self standing capability of the enclosure.

By making the protective cover with four walls, a structure which may be readily folded at the centerline of two opposed walls is thereby achieved and thereby provides a very compact storable protective cover which takes up very little storage space when not in use.

By joining the opposed sides of the walls in manner to form rigidizing beams at the juncture of the associated sides of the walls, increased support to the wall enclosure for self standing capability of the wall enclosure is thereby achieved.

By making the protective cover from a transparent plastic material, placement of the cover in protective relation over the wig without touching the wig is thereby facilitated.

By making the protective cover with six walls, a structure more closely approximating a cylinder and therefor more closely approximating the cross sectional shape of the wig, as well as requiring less material for it construction is thereby achieved.

These and other features, objects and advantages of the present invention will be better understood from the following detailed description and accompanying drawings wherein like numerals refer to like parts throughout the several views and wherein:

BRIEF DESCRIPTION OF THE DRAWINGS

FIG. 1 is a top view of a preferred embodiment of a protective cover in accordance with the present invention for wigs and the like and shown in open position over a wig;

FIG. 2 is a front elevational view of the FIG. 1 illustration and showing the protective cover in protective position over the FIG. 1 illustrative wig carried on a conventional wig stand with the protective cover and wig stand resting on a flat surface;

FIG. 3 is an end view of the FIG. 1 protective cover for wigs and the like in compact folded position suitable for storage of the protective cover when not in use;

FIG. 4 is a plan view of the FIG. 3 illustration of the protective cover when in folded position;

FIG. 5 is a top view of a second embodiment of a protective cover, in accordance with the present invention, for wigs and the like;

FIG. 6 is a front elevational view of the FIG. 5 embodiment shown resting on a flat surface;

FIG. 7 is a top view of a third embodiment of a protective cover, in accordance with the present invention, for wigs and the like; and FIG. 8 is a front elevational view of the FIG. 7 embodiment shown resting on a flat surface.

DESCRIPTION OF THE ILLUSTRATIVE EMBODIMENTS

Figures 1, 2, 3, 4, 5, 6, 7, 8:
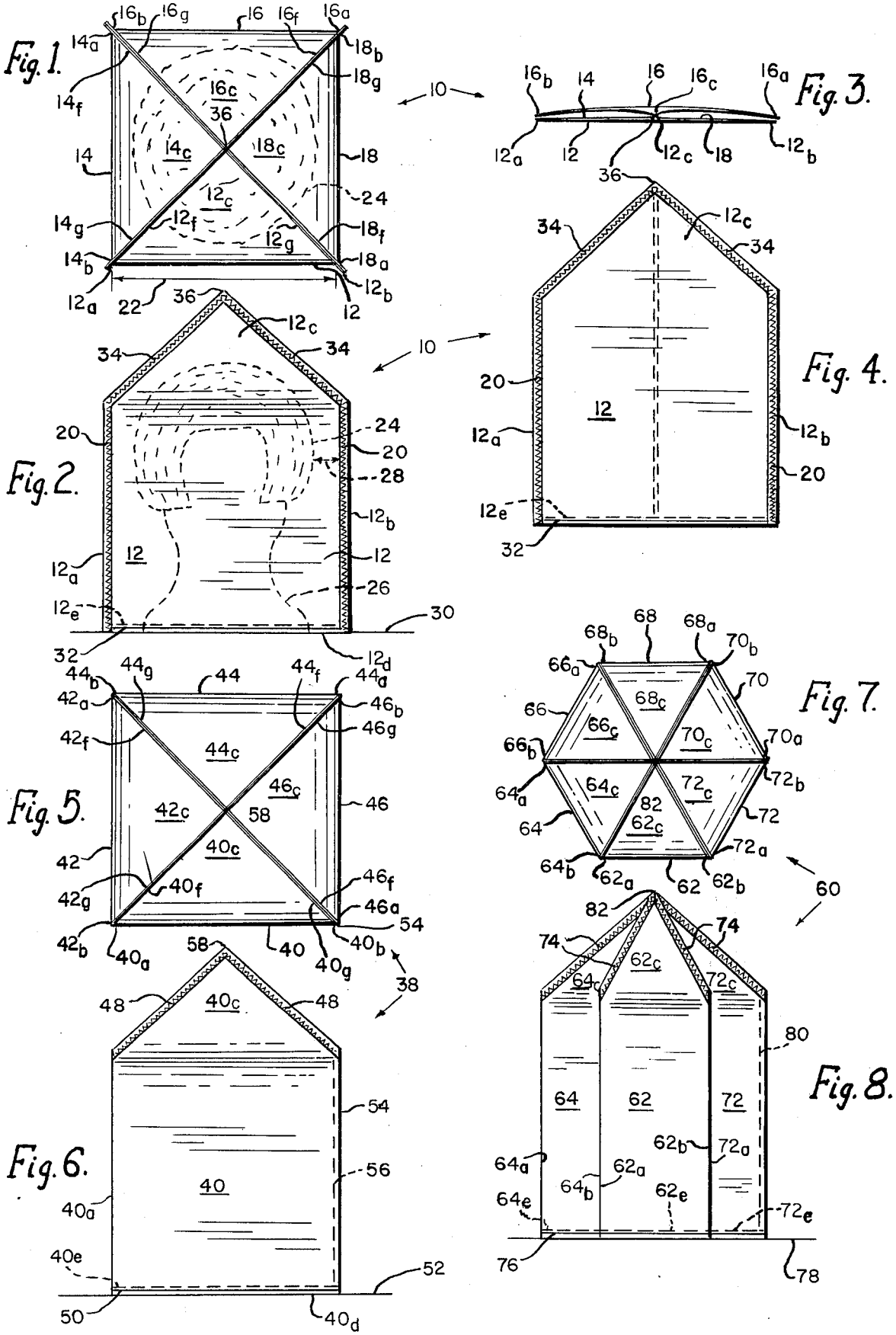

Referring to the drawings in more detail, a preferred embodiment of a protective cover for wigs and the like in accordance with the present invention is designated generally by the numeral 10 in FIGS. 1, 2, 3 and 4. The protective cover 10 has four walls 12, 14, 16 and 18 of substantially the same shape and made of a thin flexible material which is preferably transparent and plastic such as 0.003 or 0.004 inch thickness polyethylene or other suitable material. Each of the walls 12, 14, 16 and 18 has two opposed parallel sides 12*a* and 12*b*, 14*a* and 14*b*, 16*a* and 16*b*, 18*a* and 18*b* respectively and two opposed ends 12 *c* and 12*d*, 14*c* and 14*d*, 16*c* and 16*d*, 18*c* and 18*d* respectively.

Each of the opposed sides of the four walls, such as 12*a* and 12*b* of the wall 12 is joined to an associated one of the opposed sides of an adjacent wall. Thus, side 12*a* is joined to side 14*b*, side 12*b* is joined to side 18*a*. Similarly side 14*a* is joined to side 16*b* and side 16*a* is joined to side 18*b*. Joining of the sides of the walls in the present instance is by zig-zag sewing 20. However, if the material of the protective cover 10 is of a thermoplastic such as polyethylene the zig-zag sewing may be augmented or replaced by fusion heating for effecting the juncture.

Each of the walls 12, 14, 16 and 18 has a width such as 22 sufficient to form an enclosure about a wig 24 or the like carried on a conventional wig stand 26 with none of the walls touching the wig and preferably a generous space such as 28 between each of the walls and the wig 24 to thereby avoid causing a change in set of the hair of the wig 24 even over long storage periods. By way of example and not limitation, a width 22 or 8 inches has been found to be sufficient to provide generous clearance for most wigs.

The bottom end of each of the walls, such as 12*d* of wall 12 are resting on a flat surface 30 such as on a shelf or dresser (not shown). Also the bottom end of each of the walls 12, 14, 16 and 18 has preferably a turned back portion such as 12*e* (FIG. 2) in the form of a hem which is fixed to the wall by conventional sewed seam 32 or in the case of a plastic material such as polyethylene the sewed seam 32 may be augmented or substituted by heat fusion.

Each of the top ends 12*c*, 14*c*, 16*c* and 18*c* of the respective walls terminates in an isosceles triangular shaped portion having two equal sides 12*f* and 12*g*, 14*f* and 14*g*, 16*f* and 16*g*, 18*f* and 18*g* respectively. Contiguous edges of the equal sides of the isosceles triangular portions such as 12*f* and 14*g*, 14*f* and 16*g*, 16*f* and 18*g*, 18*f* and 12*g* are fixed together by sewing with zig-zag stitching 34 similar to the stitching 20, or in the case of plastic material such as polyethylene, the zig-zag stitching 34 may be augmented or replaced by heat fusion to form thereby a protective pyramid over a wig 24. And the joined edges of the triangular portions and the opposed side edges of the walls form a rigidizing framing for the protective cover 10 which enhances the self standing capability of the protective cover 10 as a protective enclosure for the wig 24. The hem 32 likewise assists in maintaining the respective walls as plane surfaces away from the wig 24 with ample space 28 between the respective walls and the wig 24. By way of example and not limitation, a height of 17 inches from the flat surface 30 to the apex 36 has been found sufficient to accomodate most conventional wigs 24 on wig stands 26.

The apex 36 of the pyramid provides a convenient and suitable point at which the protective cover 10 may be grasped with one's fingers to lower the protective cover 10 onto or lift it up away from the wig 24 without touching the wig 24 and thereby without danger of upsetting in any way the set styling of the hair of the wig 24. For the purpose of assisting in such placement or removal of the protective cover 10 without touching the wig 24, the material of which the protective cover 10 is made is preferably sufficiently transparent for the wig 24 to be visible through the walls of the protective cover 10.

When the wig 24 is not in use by the owner, the protective cover 10 may be folded into a very small space conserving package by folding two of the opposed walls such as 14 and 18 inwardly toward a centerline defined by the apex 36 as shown in FIG. 3. Walls 14 and 18 will tend to bend near the centerline defined by the apex 36 without creating a sharp crease so long as the so folded cover 10 is not weighted down with heavy objects for extended periods. From the storage position shown in FIGS. 3 and 4, the protective cover 10 may be rapidly unfolded to the use position shown in FIGS. 1 and 2 by grasping the apex 36 with one's fingers and lifting the protective cover 10 to a vertical position. Thereupon the protective cover 10 will tend to unfold by itself with very little manual assistance. Also if desired, it has been found that the folded cover 10 of FIGS. 3 and 4 may be further folded to a purse size packet (not shown) and carried in a purse without deleterious effect.

A second embodiment of a protective cover in accordance with the present invention for a wig such as the wig 24 on a wig stand 26 is designated generally by the numeral 38 in FIGS. 5 and 6. The protective cover 38 has four walls 40, 42, 44 and 46 which may be of similar shape and dimension as the walls 12, 14, 16 and 18 of the FIG. 1 embodiment and have top ends in the form of isosceles triangular portions 40*c*, 42*c*, 44*c* and 46*c* which may be of the same shape and dimension as the isosceles triangular portions 12*c*, 14*c*, 16*c* and 18*c* of the FIG. 1 embodiment. The equal side contiguous edges 40*f* and 42*g*, 42*f* and 44*g*, 44*f* and 46*g*, 46*f* and 40*g* are fixed together by zig-zag sewing stitches 48 and/or by heat fusion as explained in the FIG. 1 embodiment to form a wig protecting pyramid similar to that in FIG. 1 with rigidizing beams formed by the joined contiguous edges of the isosceles triangular portions.

The walls 40, 42, 44 and 46 likewise have bottom ends such as 40*b* with a turned back portion such as 40*e* in the form of a hem fixed to the wall 40 by a conventional sewed or heat fused seam 50 similar to that of the seam 32 of the FIG. 1 embodiment and rests on a flat surface 44 of a shelf or dresser or the like.

The protective cover 38 differs from the protective cover 10 in the structure at the junctures of adjacent opposed sides 40*a* and 42*b*, 42*a* and 44*b* and 46*b*, 46*a* and 40*b* in that those junctures are not in the form of rigidizing beams as formed by the zig-zag stitching or heat fusion 2 in the protective cover 10, but are rather simple corners or bends in the single sheet of the material of which the protective cover 38 is made and whose ends are joined at the juncture of opposed sides 46*a* and 40*b* by conventional sewing and/or heat fusion or other suitable means and leave a small excess edge 56 projecting inwardly of the juncture of sides 40*b* and 46*a*. In the protective cover 38, the rigidizing nature of the beams at the zig-zag stitching 48 together with the hem 40*e*, the bends at the side junctures and the excess edges 56 is sufficient to maintain the self standing capability of the protective cover 38 on the flat surface 52.

Apex 58 of the pyramid at the top of the protective cover 38 provides a convenient and suitable point at which the protective cover 38 may be grasped with one's fingers to lift or lower the protective cover 38 in manner similar to that explained above in connection with apex 36 of the protective cover 10. Also, when the protective cover 38 is not in use, it may be folded into a very compact package in manner similar to that explained above in connection with FIGS. 2 and 3.

A third embodiment of a protective cover for a wig 24 on a wig stand 26 is designated generally in FIGS. 7 and 8 by the numeral 60. The construction of the protective cover 38 in FIGS. 5 and 6 is similar to that of the protective cover 60 except in that the protective cover 60 has six walls 62, 64, 66, 68, 70 and 72 forming a hexagonal enclosure instead of the square enclosure of protective cover 38, and is topped by a six sided pyramid formed by the joining of contiguous edges of six isosceles triangular top wall portions 62*c*, 64*c*, 66*c*, 68*c*, 70*c* and 72*c* by zig-zag sewing stitches 74 or by heat fusion or other suitable means.

The protective cover 60 also has a turned back hem such as 62*e*, 64*e* and 72*e* at the bottom of each of its walls and fixed to the respective walls by a conventionally sewn seam 76 or other suitable means similar to that described with respect to the seam 50 in FIG. 6 and rests on a flat surface 78 such as the top of a shelf or dresser or the like. Likewise the junctures formed by the adjacent opposed wall sides 62*a* and 64*b*, 64*a* and 66*b*, 66*a* and 68*b*, 68*a* and 70*b*, 70*a* and 72*b*, 72*a* and 62*b* are corners or bends in a single sheet of material of which the protective cover 60 is made with the juncture at 72*a* and 62*b* being by conventional sewing stitches or heat fusion or other suitable means leaving inwardly projecting excess edges such as 80 similar to the excess edge 56 in FIG. 6.

Apex 82 of the pyramid at the top of the protective cover 60 provides a convenient and suitable point at which the protective cover 60 may be grasped between one's fingers to lift or lower the protective cover 60 in manner described above in connection with the apex 36 of the protective cover 10.

The rigidizing nature of the beams formed at the zig-zag stitching 74, together with the hem at the seam 76, the corners at the junctures of the six sides and the excess edges such as 80 is sufficient to maintain a self standing capability of the protective cover 60 on the flat surface 78. There being six rigidizing beams in the pyramid and six corners at the junctures of the six walls provide thereby a somewhat sturdier self standing capability of the protective cover 60 as compared to the four walled structure of the FIG. 6 protective cover 38 and requires less sheet material than that required to make the protective cover 38 because the protective cover 60 more nearly approximates a circle in cross section which more nearly approximates the cross sectional shape of the wig 24 than the square cross sectional shape of the protective cover 38.

This invention is not limited to the particular details of construction and operation described as equivalents will suggest themselves to those skilled in the art.

What is claimed is:

1. A protective cover for placement over a wig carried on a wig stand resting on a flat surface comprising:

a. thin flexible material walls of similar shape with each wall having two opposed sides and two opposed ends, b. each of the opposed sides of each of the walls being substantially parallel and joined to an associated one of the opposed sides of an adjacent wall in manner such that one end of each of the walls is in substantially the same plane, c. the walls being of a width to form a self standing enclosure about the wig with none of the walls touching the wig and with the one end of each of the walls resting on said flat surface, d. the other end of each of the walls terminating in an isosceles triangular shaped portion, e. the equal sides of the triangular shaped portions having contiguous edges fixed together to form a pyramid over said wig, and f. said contiguous edges being fixed together in manner to form beams for providing rigidizing framing for said cover to enhance the self standing capability of said enclosure.

2. The combination as in claim 1 wherein said cover has four walls.

3. The combination as in claim 2 wherein opposite sides of the walls are joined in manner to form rigidizing beams at the juncture of said associated sides to thereby provide increased support to the enclosure for self standing capability.

4. The combination as in claim 3 wherein the material of said cover is a transparent plastic of sufficient flexibility to permit said cover to be folded into a compact storable package.

5. The combination as in claim 4 wherein said material is polyethylene of approximately 0.004 inch thickness.

6. The combination as in claim 5 wherein each of said associated sides and contiguous edges of said triangular portions are joined in manner to extend outwardly from said protective cover in a substantially single vertical plane running through the center of said protective cover.

7. The combination as in claim 1 wherein said protective cover has six walls.

* * * * *